US011154459B2

(12) United States Patent
Kudek

(10) Patent No.: US 11,154,459 B2
(45) Date of Patent: Oct. 26, 2021

(54) INTRAORAL DEVICE AND METHOD FOR THE USE THEREOF

(71) Applicant: Regents of the University of Minnesota, Minneapolis, MN (US)

(72) Inventor: Matthew Robert Kudek, Minneapolis, MN (US)

(73) Assignee: Regents of the University of Minnesota, Minneapolis, MN (US)

( * ) Notice: Subject to any disclaimer, the term of this patent is extended or adjusted under 35 U.S.C. 154(b) by 161 days.

(21) Appl. No.: 16/354,766

(22) Filed: Mar. 15, 2019

(65) Prior Publication Data

US 2019/0282449 A1 Sep. 19, 2019

Related U.S. Application Data

(60) Provisional application No. 62/643,976, filed on Mar. 16, 2018.

(51) Int. Cl.
*A61J 7/00* (2006.01)

(52) U.S. Cl.
CPC ..... *A61J 7/0092* (2013.01); *A61J 7/0053* (2013.01)

(58) Field of Classification Search
CPC ..... A61J 7/0092; A61J 7/00; A61J 7/0053; A61J 7/0061; A61M 31/00; A61C 19/063; A61C 19/06; A61C 19/066; A61C 9/00; A61C 9/0006; A61C 7/08
See application file for complete search history.

(56) References Cited

U.S. PATENT DOCUMENTS

| | | | | |
|---|---|---|---|---|
| 4,106,501 | A * | 8/1978 | Ozbey | A61C 17/0211 433/80 |
| 5,516,286 | A | 5/1996 | Kushner | |
| 6,406,447 | B1 | 6/2002 | Thrash | |
| 8,205,617 | B2 * | 6/2012 | Scarberry | B29C 39/003 128/848 |
| 8,684,956 | B2 | 4/2014 | McDonough | |
| 8,734,423 | B2 | 5/2014 | Morelock | |
| 9,668,839 | B2 | 6/2017 | Fusi | |
| 9,693,928 | B2 | 7/2017 | Martin | |
| 9,770,643 | B2 | 9/2017 | Hawkins | |
| 2003/0165433 | A1 | 9/2003 | Amr | |
| 2008/0272153 | A1 | 11/2008 | Hochstadter | |
| 2013/0087157 | A1 * | 4/2013 | Hawkins | A63B 71/085 128/859 |
| 2014/0238417 | A1 * | 8/2014 | Turkbas | A61M 31/002 128/861 |
| 2016/0278899 | A1 | 9/2016 | Heller | |

(Continued)

FOREIGN PATENT DOCUMENTS

| | | |
|---|---|---|
| WO | WO 2008/086566 | 7/2008 |
| WO | WO 2013/014172 | 1/2013 |

OTHER PUBLICATIONS

International Search Report and Written Opinion, Application No. PCT/US19/22481, dated Jun. 6, 2019, 9 pages.

(Continued)

*Primary Examiner* — Nathan R Price
*Assistant Examiner* — Tasnim Mehjabin Ahmed
(74) *Attorney, Agent, or Firm* — Patterson Thuente Pedersen, P.A.

(57) ABSTRACT

This document relates to devices and methods for delivering a fluid to the surfaces of the oropharynx and/or to the palatine tonsils.

19 Claims, 7 Drawing Sheets

(56) References Cited

U.S. PATENT DOCUMENTS

| | | | |
|---|---|---|---|
| 2017/0056144 | A1 | 3/2017 | Levy |
| 2017/0333649 | A1 | 11/2017 | Djupesland |
| 2018/0147473 | A1 | 5/2018 | Franklin |

OTHER PUBLICATIONS

Schachtel, BP et al., Sore throat pain in the evaluation of mild analgesics. Clin Pharmacol Ther. 1988. 44(6) 704-711.
MINTEL market research—Cough, Cold, Flu and Allergy Remedies, US—Apr. 2017.
McAleer, S. et al., Pharmacokinetics and safety of ketorolac following isngle intranasal and intramuscular administration in healthy volunteers. Journal of Clinical Pharmacology. 2007.47(1).13-18.
de Looze, F. et al., Efficacy of flurbiprofen 8.75 mg spray in patients with sore throat due to an upper respiratory tract infection: A randomised controlled trial. European Journal of General Practice. 2016. 22(2). 111-118.
Radkova, E., et al., Efficacy of flurbiprofen 8.75 mg delivered as a spray or lozenge in patients with sore throat due to upper respiratory tract infection : a randomized , non-inferiority trial in the Russian Federation. Journal of Pain Research. Oct. 2017. 1591-1600.
Schachtel, B. et al., Demonstration of dose response of flurbiprofen lozenges with the sore throat pain model. Clin Pharm and Thera. 2002. 71(5) 375-380.
Limb, M. et al., Scintigraphy can be used to compare delivery of sore throat formulations.International Journal of Clinical Practice. 2009.63(4). 606-612.
Schachtel, B. et al., Flurbiprofen 8.75 mg lozenges for treating sore throat symptoms: a randomized, double-blind, placebo-controlled study. Pain Management. 2016. 6(6). 519-529.
Aspley, S. et al., Efficacy of flurbiprofen 8.75 mg lozenge in patients with a swollen and inflamed sore throat. Current Medical Research and Opinion. 2016. 32(9) 1529-1538.

* cited by examiner

CORONAL VIEW

AXIAL VIEW

INTRAORAL DEVICE AND METHOD FOR THE USE THEREOF

RELATED APPLICATION

This application claims the benefit of U.S. Provisional Application No. 62/643,976 filed on Mar. 16, 2018, the entirety of which is incorporated herein by reference.

TECHNICAL FIELD

This document pertains to the field of treatment of various clinical illnesses and symptoms related to one's oropharynx and the structures and features therein. This may include, but is not limited to, treatment for clinical sore throat (also known as pharyngitis) generally secondary to etiologies including infection, iatrogenic cause including mechanical irritation, trauma, or drug side effect, post-operative complications, and tissue hypertrophy. More particularly, but not by way of limitation, this document relates to devices and methods for delivering a fluid to the surfaces of the oropharynx and/or to the palatine tonsils (hereinafter "tonsils").

BACKGROUND

During the course of an illness, oropharyngeal mucosal surfaces and tonsils may become irritated, swollen, and inflamed. Generally, the oropharynx is defined as the area including the posterior soft palate and uvula to the superior, the tongue to the inferior, the palatopharyngeal arches and palatine tonsils bilaterally, and the posterior wall of the pharynx. The palatine tonsils are lymphoid tissue situated posterior to the palatopharyngeal arches bilaterally within the throat. Common illnesses where one may experience this symptom include a viral upper respiratory illness (also referred to as "the common cold"), influenza or influenza-like illness, other viral and bacterial illness that cause tonsillar hypertrophy (such as mononucleosis or strep throat). Inflammation of the oropharyngeal or tonsillar tissues is collectively known as pharyngitis or tonsillitis, respectively.

Pharyngitis results in symptoms including moderate to severe throat pain (sore throat), odynophagia (painful swallowing), and dysphagia (difficulty with swallowing). Commonly, these symptoms interfere with and cause difficulty in performing common activities of daily living (due to pain related to swallowing while eating and drinking) as well as communication and interaction with others (from throat pain while talking). In more severe cases, the inflammation and irritation of these mucosal tissues leads to a profound inability to tolerate enteral intake, which can result in clinical dehydration and other significant clinical concerns.

Pharyngitis may also occur because of mechanical trauma and irritation. Examples of when this may occur include placement of a nasoenteral tube (often used for feeding or gastric venting), placement of an endotracheal tube, or following a surgical or procedural intervention. This contact irritation results in pharyngitis and localized symptoms of the oropharynx and tonsils similar to those mentioned above. Placement of a nasoenteral tube requires passage of the tube through a naris, nasal cavity, and throat terminating in one's gastrointestinal tract so that the distal tip is located in an appropriate position within either the stomach or small intestine. Placement of these tubes can be difficult, particularly in the pediatric population, often requiring varying degrees of sedation for the procedure. In part, this is due to painful stimulation of the oropharyngeal mucosa, which also commonly triggers the gag reflex. An indwelling nasoenteral tube also causes similar discomfort. Before a nasoenteral tube is removed, patients will commonly need to prove that they are able to eat and drink by mouth (known as an "oral challenge"). Many patients find this difficult because of this ongoing mechanical irritation to the oropharyngeal tissues, resulting in a self-perpetuating cycle of pain and inability to tolerate oral intake.

Operative procedures, which may include tonsillectomy, adenoidectomy, or uvulopalatopharyngoplasty, may also lead to significant post-operative pain due to mechanical irritation, which may include incision, scraping, or cautery of the highly innervated tissues of the oropharynx and tonsils within the course of an operative procedure. With the dense vascularity of the tissues within this region, there may also be post-operative complications including undesired bleeding.

Yet another cause of pharyngitis is as a side of effect of various chemotherapeutic agents. Certain cytotoxic medications, used in the treatment of various malignancies, result in decreased mucosal cell turnover and surface sloughing, which results in mucositis. This often occurs across multiple mucosal surfaces in one's body, including those in the oropharynx. Mucositis is often extremely painful and may result in one's inability to tolerate enteral nutrition (again, resulting in dehydration or malnutrition). While topical sprays and other ingestible medications exist to treat mucositis-associated pain, they are often largely ineffective at targeting mucosal surfaces beyond the oral cavity. The use of topical localized anesthetics of ester and amide classification (e.g., medications ending in "-caine"), can be effective in providing analgesic relief in the oral cavity. To mitigate the risk for systemic toxicity, these medications are typically expectorated (not swallowed), thereby limiting their contact with mucosal surfaces distal to the oral cavity.

OVERVIEW

Currently available products that are employed for treatment of pharyngitis include systemic analgesic medications (commonly, acetaminophen and NSAIDs), medicated throat lozenges, oral sprays, and oral rinses. The present inventor recognizes that limitations of current products include: a prolonged time between ingestion of a dose of medication until an appreciable onset of relief, variable duration of relief often resulting in high frequency of redosing to maintain appreciable relief, and a lack of ability to provide a truly symptom-specific, targeted therapy.

The present inventor further recognizes that existing devices and methods for delivery of a fluid or liquid to a user's mouth have varying mechanisms of deployment of the fluid or liquid towards the intended target, but rely on medication reservoirs external to the user's mouth. These features, either independently or in combination, result in bulky and cumbersome devices that are difficult to operate and have poor portability, which limits the ability for use at various time points during a day.

A present oral device for delivery of a fluid (e.g., a liquid) can comprise a teeth engagement member, a fluid reservoir, and one or more fluid outlets. The teeth engagement can be configured for engagement with the upper or lower teeth of a user and can have at least a facial or lingual portion, which is adapted for engagement with the facial or lingual surfaces of the teeth, and a bite portion, which is adapted for engagement with the occlusal or incisal surfaces of the teeth. The fluid reservoir can be positioned within the bite portion of the teeth engagement member, and can have an upper or lower surface that projects relative to adjacent surfaces of the bite portion. The one or more fluid outlets can be used to deliver fluid to one or more locations in the mouth or throat upon depression of the projecting upper or lower surface of the fluid reservoir.

A present method can comprise inserting an oral device, which includes a teeth engagement member, a fluid reservoir and one or more fluid outlets, into the mouth of a user. The teeth engagement member can be engaged with the upper or lower teeth of the user by positioning a facial or lingual portion of the teeth engagement member adjacent facial or lingual surfaces of the teeth and positioning a bite portion of the teeth engagement member adjacent occlusal or incisal surfaces of the teeth. With the oral device appropriately positioned, a biting force can be applied to an upper or lower surface of the fluid reservoir, thereby dispersing fluid stored in the fluid reservoir from the one or more fluid outlets.

These and other examples and features of the present devices and methods will be set forth, at least in part, in the following Detailed Description. This Overview is intended to provide non-limiting examples of the present subject matter—it is not intended to provide an exclusive or exhaustive explanation. The Detailed Description below is included to provide further information about the present devices and methods.

BRIEF DESCRIPTION OF THE DRAWINGS

In the drawings, like numerals can be used to describe similar features and components throughout the several views. The drawings illustrate generally, by way of example, but not by way of limitation, various device and method embodiments discussed in this patent document.

The drawings are not necessarily to scale. Certain features and components may be shown exaggerated in scale or in schematic form, and some details may not be shown in the interest of clarity and conciseness.

DETAILED DESCRIPTION

This disclosure features a device that may deliver a fluid or liquid, such as a drug, to the oropharynx and/or tonsils of a user.

Figure 1B:
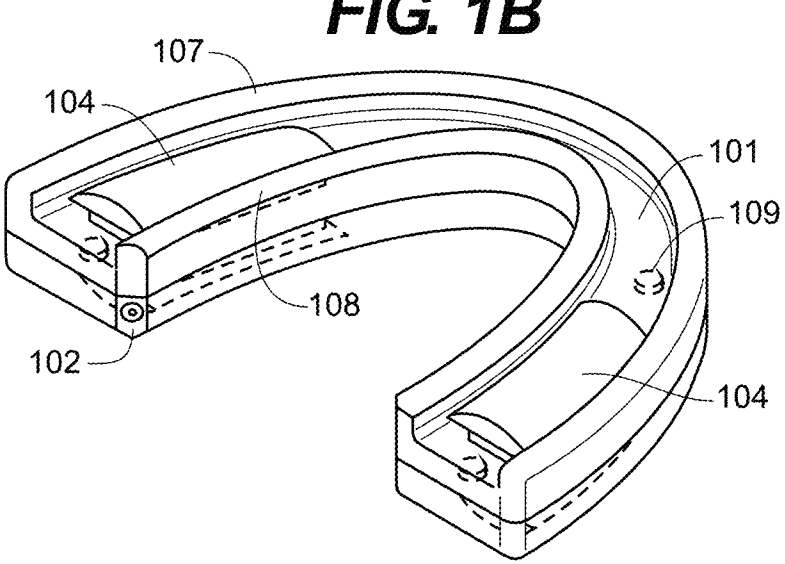
FIGS. 1A-1D illustrates an embodiment of an intraoral device, sized to engage the maxillary and mandibular dentition, with multiple fluid reservoirs and fluid outlets.
Figure 1A:
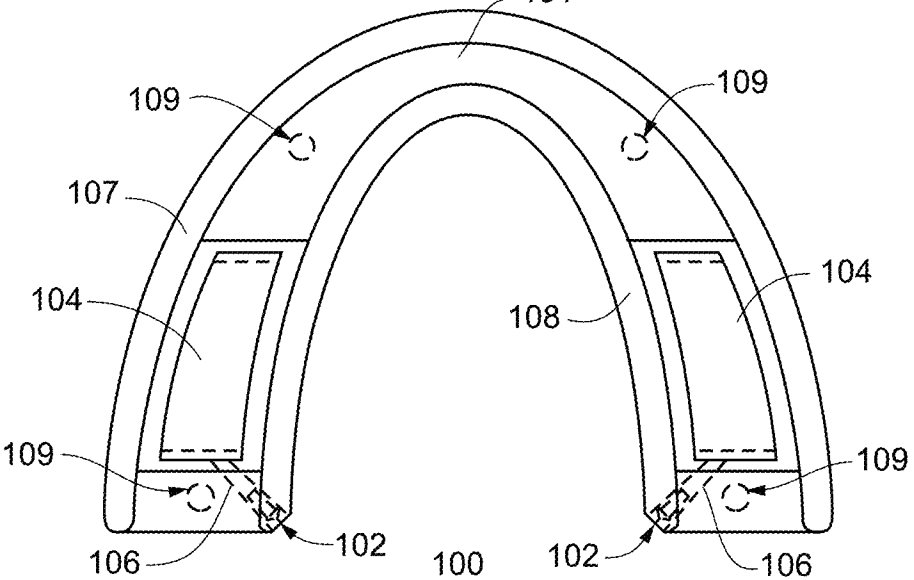
Figure 1D:
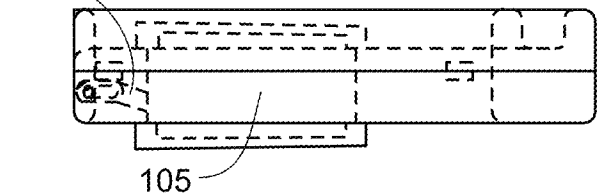
Figure 1C:
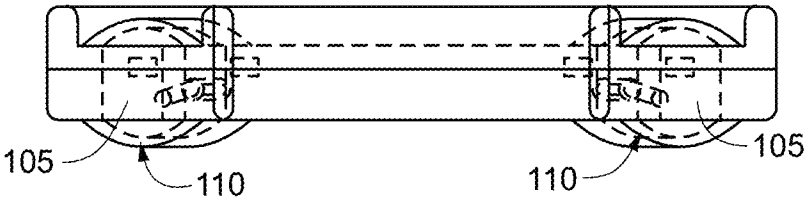
Figure 2:
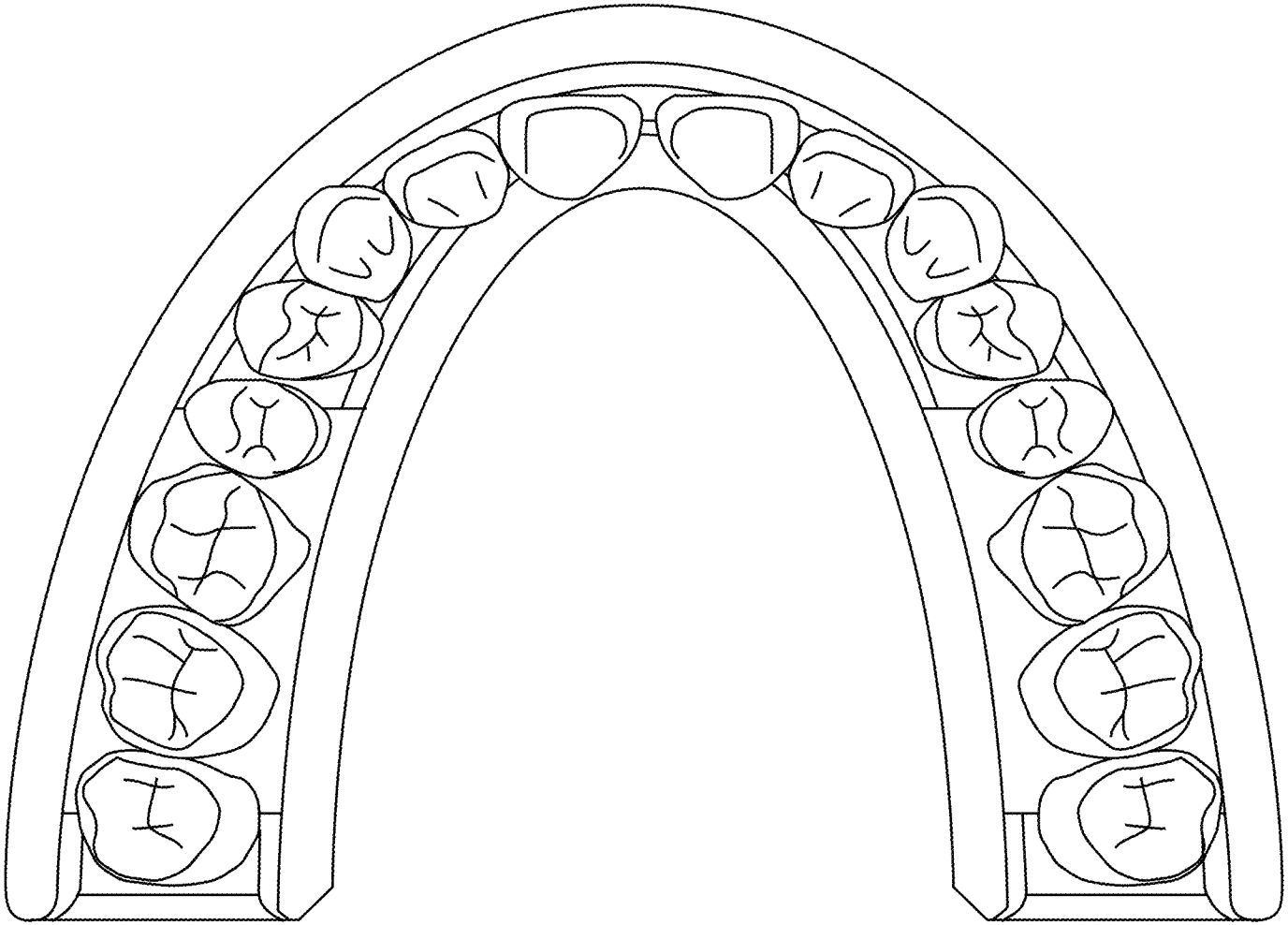
FIG. 2 illustrates a top view of the embodiment depicted in FIGS. 1A-1D with an overlying representation of the approximate positioning of dentition with respect to the device when the device is positioned intraorally. The bite surfaces of the teeth are shown in lighter/hatched shade overlying the device.

FIGS. 1A-1D illustrates an embodiment of an intraoral device 100, sized to engage between the maxillary and mandibular dentition, with multiple fluid reservoirs and fluid outlets. FIGS. 3A-3D illustrates an additional embodiment of an intraoral device 300, sized to engage between a subset of maxillary and mandibular dentition, with a single fluid reservoir and fluid outlet. In each device, there is an aspect that is for engagement of the user's teeth. In some embodiments, this includes at least a facial (107, 307) or lingual (108, 308) portion that is adapted for engagement with the facial or lingual surfaces of the user's teeth. FIG. 2 illustrates a top view of one embodiment of the intraoral device with an overlying representation of the approximate positioning of dentition with respect to the device when positioned intraorally.

Figure 4:
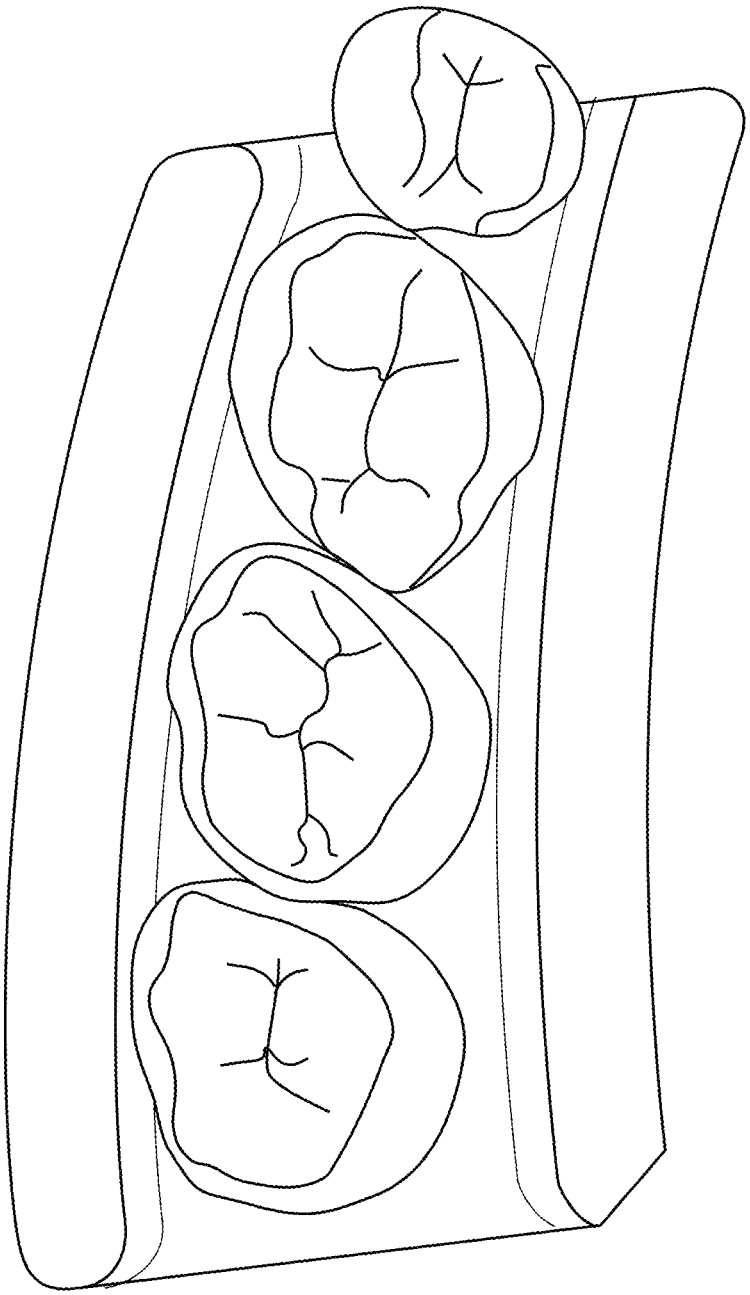
FIG. 4 illustrates a top view of the embodiment depicted in FIGS. 3A-3D with an overlying representation of the approximate positioning of dentition with respect to the device when positioned intraorally. The bite surfaces of the teeth are depicted to be overlying the drawing of the device.

FIG. 4 illustrates a view of a second embodiment with overlying depiction of the bite surfaces of a subset of the user's teeth. Numerals 101 and 301 depict a portion of the device that is engaged between the occlusal surfaces or incisal edges of the user's teeth, which may also be referred to as the bite surfaces of the teeth. The device may engage any number of the user's maxillary or mandibular teeth. When in use, the bite section of the device should be seated between corresponding maxillary and mandibular teeth. In the embodiments depicted, the device 100, 300 is seated between a user's teeth without fitting securely thereon or thereover, though in other embodiments the device can be configured to fit on or over one or both of a user's upper or lower teeth (i.e., similar to dental or orthodontial retainer devices and mouthguards).

The device 100, 300 can comprise a variety of different materials. In one example, the device 100, 300 comprises silicone, such as silicone rubber. In other examples, the device 100, 300 comprises a resin, vinyl, ethyl vinyl acetate (EVA), laminate, plastic, thermoplastic, elastomer, polymer, or other suitable material or combination of materials.

In some embodiments, there is a plurality of fluid reservoirs (105, 305) contained within the bite portion of the teeth engagement member of the device. In such embodiments, the plurality of fluid reservoirs (105, 305) is intraoral, within a user's mouth during use. In some embodiments, these reservoirs each encompass volumes between 1 cubic centimeter and 15 cubic centimeters, such as volumes between 1 cubic centimeter and 10 cubic centimeters, or volumes between 1 cubic centimeter and 5 cubic centimeters.

Figure 3B:
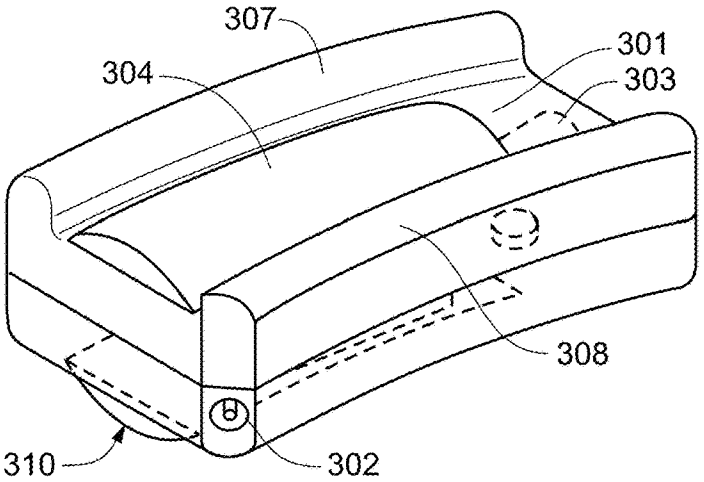
FIGS. 3A-3D illustrates an embodiment of an intraoral device, sized to engage between a subset of maxillary and mandibular dentition, with a single fluid reservoir and fluid outlet.
Figure 3D:
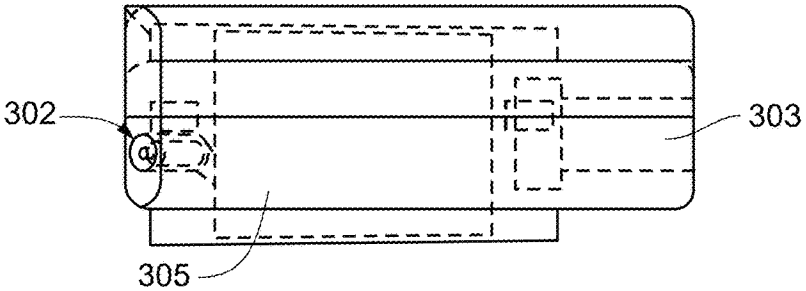
Figure 3A:
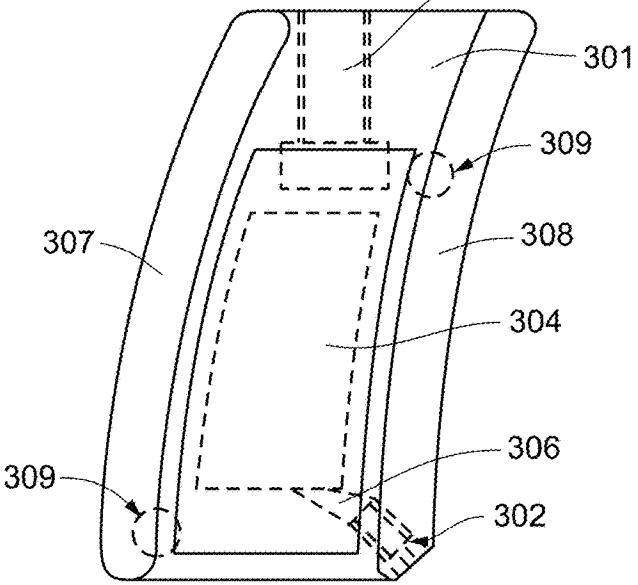
Figure 3C:
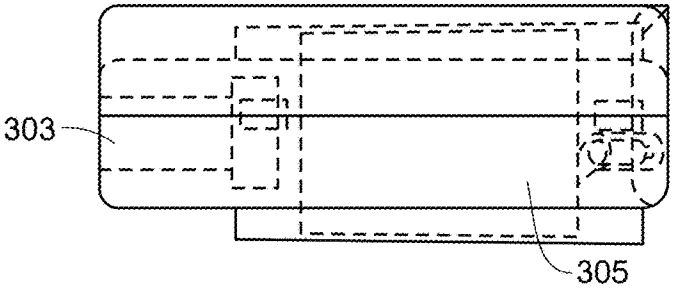

Additionally, there is an upper (104, 304) and/or lower (110, 310) bite surface of the reservoir which may be raised with respect to the remainder of the bite surface of the device, to allow engagement with the bite surfaces of the user's teeth. As shown in FIGS. 1C and 1D, the fluid reservoir 105 may be bounded by upper and lower raised surfaces 104 and 110, and whose lateral walls may be contained within device portion 101. As shown in FIGS. 3C and D, the fluid reservoir 305 may be bounded by upper and lower raised surfaces 304 and 310, and whose lateral walls may be contained within device portion 301.

In embodiments, the plurality of fluid reservoirs (105, 305) defines a maximum volume of a fluid to be delivered.

In other words, all of the fluid to be delivered by the device 100 is contained, intraorally, in the fluid reservoirs (105, 305).

Figure 6B:
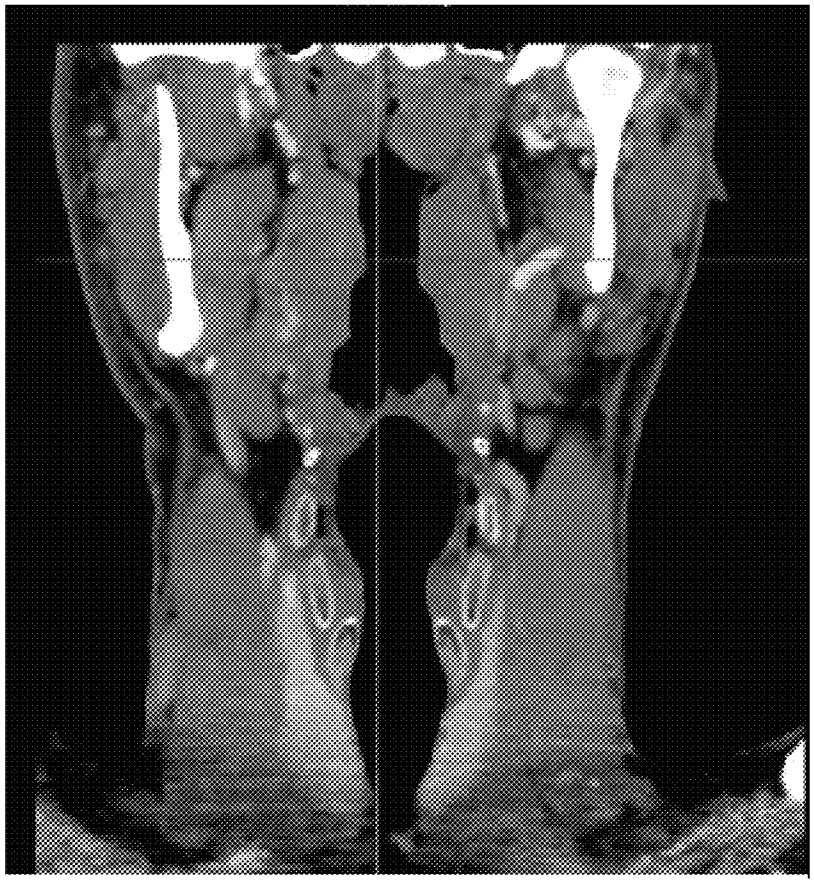
FIGS. 6A-6B illustrates cross-sectional views of a representative computed tomography (CT) scan, wherein the cross-sectional area of the palatine tonsils are highlighted in red. Geometric angles are superimposed onto the axial cross-section, originating from the deepest right molar. The tooth line is depicted as the colored line directed along the row of teeth and corresponds to the linear arrangement in an oblique axis traversing the front to the back of the mouth.
Figure 6A:
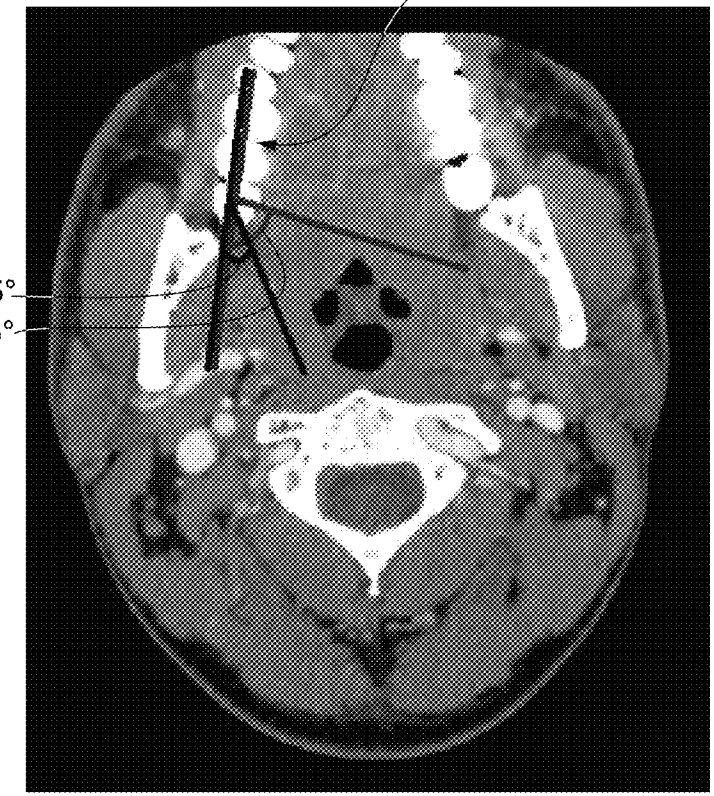
Figure 7:
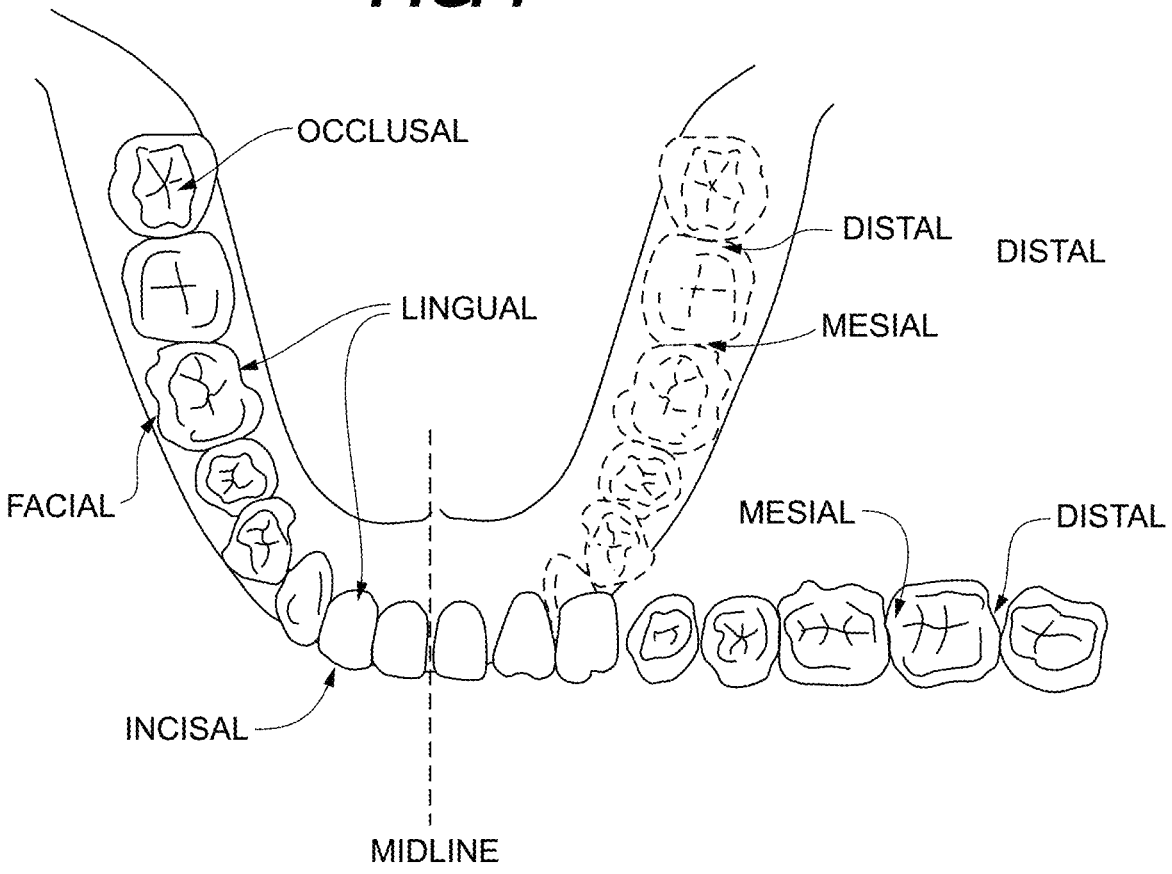
FIG. 7 illustrates common nomenclature of the various faces and aspects of dentition.

Within the device, there can also be a plurality of fluid outlets (106, 306) connecting the fluid reservoirs to the external surface of the device. These outlets may be aimed towards predetermined sites and at various anatomical structures within the user's mouth or oropharynx. Preferably, the outlets will be aimed towards the oropharynx, posterior pharyngeal wall, and/or tonsils. In order to achieve this, the outlets can be angled inward between 20 to 120 degrees from the tooth line of the user's teeth. FIG. 6A illustrates an axial view of an individual cross-section of a CT scan, wherein general measurements of the angle between the tooth line and tonsils may be measured. Additional angle ranges from the tooth line for fluid outlets within preferred embodiments of the device include 20 to 120 degrees, 30 to 90 degrees, and 20 to 60 degrees, for example. Additionally, the outlets may be positioned in the horizontal axis, or may be angled off horizontal at a direction cranially or caudally between −60 degrees to +60 degrees, or between −30 degrees to +30 degrees, or between −60 degrees to 0 degrees, or between −30 degrees to 0 degrees, or between 0 degrees to +30 degrees, or between 0 degrees to +60 degrees, for example.

In some embodiments, the fluid outlets can also contain spray nozzles (102, 302) at their openings. The geometric configuration of the spray nozzle (which may include geometries such as circular, semicircular, rectangular, full or partial cone, flat fan, and/or flood) will also dictate the swath of area to which the fluid is directed. The size of droplet may be modulated by adjustment of the area of the luminal opening within the spray nozzle (102, 302), to produce droplet size that may range between less than 100 micrometers to more than 500 micrometers in diameter in order to allow the fluid droplets to reach the desired surface within the user's oral cavity, oropharynx, or tonsils.

Engagement of a user's teeth with the raised surfaces (104, 304, 110, 310), in particular by biting down, causes fluid in at least one of the plurality of fluid reservoirs (105, 305) to be expelled. In other embodiments, the device 100 is configured such that other parts of a user's mouth can engage one or more portions of the device 100 to cause fluid to be expelled from the plurality of fluid reservoirs (105, 305), such as the tongue, lips or cheeks. In still other embodiments, creating pressure on the device 100, such as by swallowing or sucking in air, can create or facilitate expelling of fluid from the plurality of fluid reservoirs (105, 305).

It may also be beneficial for the fluid reservoirs to have inlet channels separate from the outlets. These can be useful to allow for filling of the fluid reservoir from an external source prior to use of the device. These one-way channels are not depicted on FIGS. 1A-1D or FIGS. 3A-3D, but may originate on an outer surface of the device and traverse through sections 101 or 301, 107 or 307, and/or 108 or 308 of these embodiments into the fluid chamber 105 or 305. Fitting the inlet channels with one-way valves to prevent fluid flow in the direction from inside of the reservoir to outside of the device will prevent undesired flow of fluid out of the reservoir when the reservoir is compressed. Additionally, the inlet chambers fitted with one-way valves also allow for re-inflation of the reservoir by air or fluid following the release of compression of the fluid chamber. This re-inflation would allow for recoil of the raised, bite surfaces (104 and/or 110, 304 and/or 310) of the reservoir (105, 305) that contact the bite surfaces of the user's teeth between mechanical compressions of the reservoir.

In some embodiments, the reservoir 105, 305 includes or is configured to receive a cartridge (not depicted) that contains the fluid to be delivered by the device 100, 300. The cartridge can be disposable and contain one or more doses of fluid. For example, the cartridge can comprise a single dose of fluid, 3 or more doses of fluid, 5 or more doses of fluid, 10 or more doses of fluid, 15 or more doses of fluid, 20 or more doses of fluid, 25 or more doses of fluid, or some greater or lesser number of doses of fluid. In other embodiments, the cartridge can be reusable and refillable. The number of doses contained within a particular cartridge can be selected or prescribed according to a fluid to be delivered, a treatment time or duration, or some other factor. The cartridges themselves can designed to fluidly couple and interact with the fluid outlets 106, 306, spray nozzles 102, 302, inlet channels and other features to provide for delivery of fluid within the cartridge via the device 100, 300.

To accommodate cartridges, reservoirs 105, 305 or device 100, 300 can be arranged to allow for cartridges to be inserted and removed. For example, the reservoirs 105, 305 can comprise an aperture or portion that opens or closes to allow cartridges to be inserted or removed, or the device 100, 300 itself can comprise a hinged, two-piece, or other configuration that provides selective access to the reservoirs 105, 305 to allow cartridges to be inserted and removed as needed or desired. In these embodiments, the devices 100, 300 optionally can comprise a coupling or engagement mechanism to enable different portions of the device 100, 300 to fit or be secured together. As shown in FIG. 1, device 100 can comprise corresponding sets of apertures and pegs 109 that fit together to engage top and bottom portions of the device 100. A similar concept is shown in FIG. 3, as device 300 also can comprise corresponding sets of apertures and pegs 309 that fit together to engage top and bottom portions of the device 300. In other examples, magnets or other coupling mechanisms can be used at 109, with more or fewer than are depicted in FIG. 1 used in other embodiments. In other embodiments, the structures or mechanisms depicted at 109 in FIG. 1 can be omitted entirely.

Figure 5:
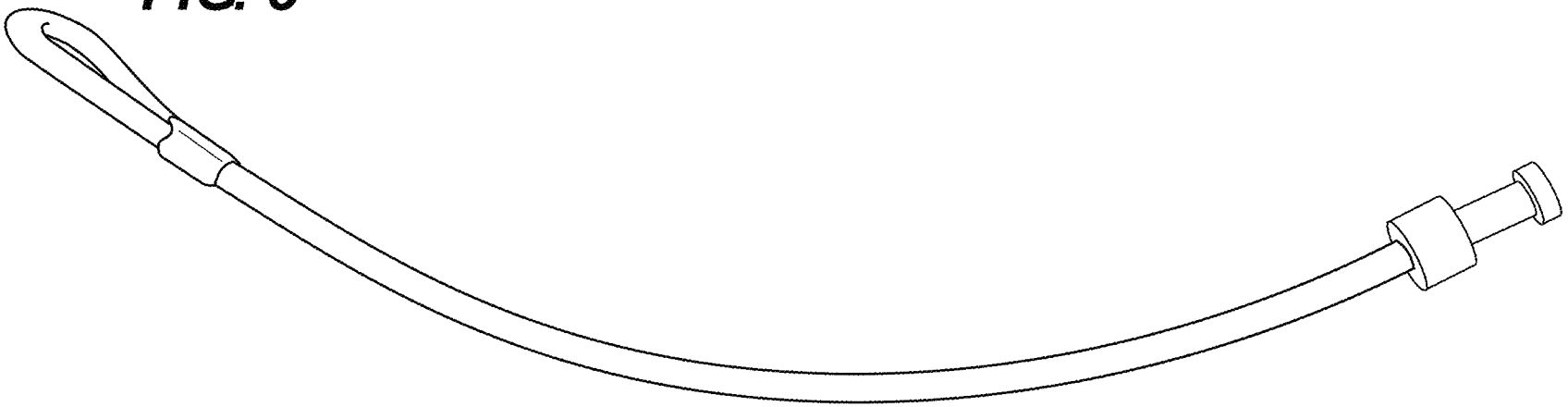
FIG. 5 illustrates an example of an attachment that may be affixed to the embodiment illustrated in FIG. 4, for example, to act as a tether and/or positioning device.

Within a device embodiment, there may also be a receptacle or tract (303) to allow for reception of an attachment to act as a tether and/or positioning device. The use of such an attachment may allow for transportation of the device, insertion of the device into the oral cavity, maneuvering of the device within the oral cavity, and removal of the device from the oral cavity. An example of an attachment that may be attached to the device is shown in FIG. 5. The configuration and position of receptacle or tract 303 can vary from that depicted in FIGS. 3A-3D, as can the type and configuration of the attachment depicted in FIG. 5. Additionally, device 100 of FIGS. 1A-1D also can comprise a similar receptacle or tract, which in one example is arranged at or near the portion of the device that would be near the user's front teeth in use.

The tether also can be configured to secure a protective housing, case or covering (not depicted) for device 100 or 300. For example, the smaller size of device 300 in FIGS. 3A-3D makes it highly portable, and providing a case that protects device 300 when not in use enables the device 300 to be kept clean while being stored or transported, such as in a bag, purse, pocket, or other manner. The device 300 then can be removed from the case for use, with the case removed from or instead slid to a distal end of the tether, so that the device 300 is exposed and can be inserted into the user's oral cavity. Such a tether and case configuration also can be used with device 100 of FIGS. 1A-1D. In some embodiments, a case can be used independently of any tether or otherwise as a user may prefer.

Embodiments of the devices 100, 300 disclosed herein can be manufactured in a variety of ways. For example, the devices 100, 300 can be injection molded. In other embodiments, the devices 100, 300 can be three-dimensionally printed. Those having skill in the art will recognize that the devices 100, 300, as well as other components and accessories disclosed herein, also can be manufactured in other ways.

A method for using the device can be as follows. The user inserts the device into the oral cavity, such that the bite surface of the device is seated between the incisal and/or occlusal surfaces of opposing upper and lower teeth. The device should also be positioned such that the fluid outlets are aimed at the intended target within the user's oral cavity or oropharynx. With the use of a bite force, where the mandible is drawn up towards the maxilla, thereby bringing the bite surfaces of mandibular teeth towards the bite surfaces of maxillary teeth, the upper and/or lower walls of the fluid reservoir(s) is/are depressed. This thereby compresses the volume within the fluid reservoir, resulting in expulsion of fluid from the fluid outlets towards the intended features or anatomical structures. The user can then relax his/her bite, allowing the depressed walls of the fluid reservoirs to return to their original geometries. The user may repeat this sequence of events to expel fluid from the device multiple times to achieve the desired effect. Once this has been completed, the device can be removed from the user's mouth and stored external to the user's mouth for a desired interval.

The material delivered by the device 100, 300 can comprise a fluid (such as a liquid or a gas), a suspension, an aerosol, or some other material or combination of materials. In some embodiments, reservoirs 105, 305 or a cartridge to be arranged therein can comprise two or more materials separated by a rupturable barrier or other structure, such that the barrier can be ruptured by the user before or as the device 100, 300 is used in order to combine or mix the two or more materials before or at delivery.

The above Detailed Description includes references to the accompanying drawings, which form a part of the Detailed Description. The Detailed Description should be read with reference to the drawings. The drawings show, by way of illustration, specific embodiments in which the present devices and methods can be practiced. These embodiments may also be referred to as "examples."

The above Detailed Description is intended to be illustrative and not restrictive. For example, the above-described examples (or one or more features or components thereof) can be used in combination with each other. Other embodiments can be used, such as by one of ordinary skill in the art upon reviewing the above Detailed Description. Also, various features or components have been or can be grouped together to streamline the disclosure. This should not be interpreted as intending that an unclaimed disclosed feature is essential to any claim. Rather, inventive subject matter can lie in less than all features of a particular disclosed embodiment. Thus, the following claims are hereby incorporated into the Detailed Description, with each example standing on its own as a separate embodiment.

Certain terms are used throughout this patent document to refer to particular features or components. As one skilled in the art will appreciate, different people may refer to the same feature or component by different names. This patent document does not intend to distinguish between components or features that differ in name but not in function.

The recitation of numerical ranges by endpoints includes all numbers and sub-ranges within and bounding that range. For example, 20 to 120 degrees includes 20 degrees, 21 degrees, 22 degrees, 23 degrees, etc. and 20 to 25 degrees, 20 to 60 degrees, 30 to 90 degrees, etc.

The scope of the present devices and methods should be determined with reference to the appended claims, along with the full scope of equivalents to which such claims are entitled. In the appended claims, the terms "including" and "in which" are used as the plain-English equivalents of the respective terms "comprising" and "wherein." Also, in the following claims, the terms "including" and "comprising" are open-ended; that is, a device or method that includes features or components in addition to those listed after such a term in a claim are still deemed to fall within the scope of that claim.

The invention claimed is:

1. An intraoral device for delivery of a fluid, comprising:

a teeth engagement member for engagement with at least one of the upper or lower teeth of a user, the teeth engagement member having a bite portion adapted for engagement with occlusal or incisal surfaces of at least one engaged tooth;

a fluid reservoir positioned within the bite portion of the teeth engagement member and defining a maximum volume of a fluid to be delivered by the intraoral device in use, wherein at least one of an upper surface or a lower surface of the fluid reservoir projects relative to adjacent surfaces of the bite portion; and one or more fluid outlets through which the fluid is delivered to one or more locations in the mouth or throat upon depression of the projecting upper or lower surface of the fluid reservoir.

2. The intraoral device of claim 1, further comprising one or more fluid inlets through which fluid may be received into the fluid reservoir.

3. The intraoral device of claim 2, wherein each of the one or more fluid inlets includes a one-way valve adapted to allow fluid flow into the fluid reservoir and prevent fluid flow out of the fluid reservoir.

4. The intraoral device of claim 1, wherein the fluid reservoir is integrated with the bite portion of the teeth engagement member at a location that is adapted for engagement with at least one of the occlusal surfaces of the teeth or the incisal surfaces of the teeth.

5. The intraoral device of claim 4, further comprising at least one fluid delivery conduit adapted to deliver fluid from the fluid reservoir to the one or more fluid outlets.

6. The intraoral device of claim 1, wherein the fluid reservoir is configured to receive a fluid-containing cartridge.

7. The intraoral device of claim 1, wherein the one or more fluid outlets are positioned at a juncture between a lingual portion and the bite portions of the teeth engagement member.

8. The intraoral device of claim 1, wherein each of the one or more fluid outlets includes a spray nozzle.

9. The intraoral device of claim 1, wherein the one or more fluid outlets are at least one of:

oriented at an angle in a range of 20 degrees to 120 degrees relative to a plane parallel to a major surface of the bite portion; or oriented inwardly at an angle in a range of 20 degrees to 120 degrees from a tooth line of a user's teeth.

10. The intraoral device of claim 9, wherein, in use, the one or more fluid outlets are oriented toward side or back walls of the throat.

11. The intraoral device of claim 1, further comprising a fluid contained in the fluid reservoir.

12. The intraoral device of claim 1, wherein the teeth engagement member further comprises at least one of a facial or lingual portion adapted for engagement with facial or lingual surfaces, respectively, of at least one tooth.

13. The intraoral device of claim 12, wherein the teeth engagement member includes the facial portion, the lingual portion, and the bite portion to collectively define one of:

a generally U-shaped channel in which a plurality of teeth of the user are received, or a generally linear channel in which at least one tooth of the user is received.

14. An intraoral device for delivery of a fluid, comprising:

a teeth engagement member for engagement with at least one of the upper or lower teeth of a user, the teeth engagement member having a bite portion adapted for engagement with occlusal surfaces of at least one engaged tooth;

a fluid reservoir positioned within the bite portion of the teeth engagement member and defining a maximum volume of a fluid to be delivered by the intraoral device in use, wherein at least one of an upper surface or a lower surface of the fluid reservoir projects relative to adjacent surfaces of the bite portion;

one or more fluid outlets through which the fluid is delivered from the fluid reservoir to an oropharynx region upon depression of the projecting upper or lower surfaces of the fluid reservoir; and one or more fluid inlets through which the fluid is received into the fluid reservoir.

15. A method, comprising:

inserting an intraoral device into the mouth of a user, the intraoral device including a teeth engagement member, a fluid reservoir, and one or more fluid outlets, the fluid reservoir defining a maximum volume of a fluid to be delivered by the intraoral device in use, wherein at least one of an upper surface or a lower surface of the fluid reservoir projects relative to adjacent surfaces of the bite portion;

engaging the teeth engagement member by at least one of upper or lower teeth of the user, including positioning a bite portion of the teeth engagement member adjacent occlusal or incisal surfaces of at least one engaged tooth; and applying a biting force to depress the projecting upper or lower surface of the fluid reservoir, thereby dispersing fluid contained within the fluid reservoir from the one or more fluid outlets.

16. The method of claim 15, further comprising, prior to inserting the oral device into the mouth of the user, inserting a fluid cartridge into the fluid reservoir.

17. The method of claim 15, wherein applying the biting force includes engaging an occlusal surface of the teeth with the projecting upper or lower surface of the fluid reservoir.

18. The method of claim 15, wherein the one or more fluid outlets are orientated toward an oropharynx region when the intraoral device is inserted.

19. The method of claim 15, further comprising filling the fluid reservoir with fluid via one or more fluid inlets.

* * * * *